US009217593B2

(12) United States Patent
Ikushima

(10) Patent No.: US 9,217,593 B2
(45) Date of Patent: Dec. 22, 2015

(54) COOLING SYSTEM AND MAINTENANCE TIMING DETERMINATION METHOD

(71) Applicant: SUMITOMO HEAVY INDUSTRIES, LTD., Tokyo (JP)

(72) Inventor: Yuki Ikushima, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 225 days.

(21) Appl. No.: 13/845,280

(22) Filed: Mar. 18, 2013

(65) Prior Publication Data

US 2013/0312428 A1 Nov. 28, 2013

(30) Foreign Application Priority Data

May 22, 2012 (JP) ..... 2012-116653

(51) Int. Cl.
*F25B 9/00* (2006.01)
*F25B 49/00* (2006.01)
*F25B 9/14* (2006.01)

(52) U.S. Cl.
CPC ..... *F25B 49/005* (2013.01); *F25B 9/14* (2013.01); *F25B 2500/06* (2013.01); *F25B 2600/01* (2013.01)

(58) Field of Classification Search
CPC ..... F25B 49/055; F25B 2600/01; F25B 2500/06; F25D 21/02
USPC ..... 62/6
See application file for complete search history.

(56) References Cited

U.S. PATENT DOCUMENTS 4,362,024 A * 12/1982 Winkler ..... F25B 9/14 137/625.37
4,951,471 A * 8/1990 Sakitani ..... F25B 9/10 250/352
5,465,584 A * 11/1995 Mattern-Klosson .... F04B 37/08 417/901
2005/0166600 A1 8/2005 Mitsubori
2005/0223714 A1* 10/2005 Li ..... F25B 9/145 62/6
2011/0016890 A1 1/2011 Kimura

FOREIGN PATENT DOCUMENTS

JP H09-210517 8/1997
JP 2001-221564 8/2001
JP 2001221564 * 8/2001 ..... F25D 21/02
JP 2001221564 A * 8/2001 ..... F25D 21/02
JP 2003-324010 11/2003
JP 2004-162943 6/2004
JP 2005-123313 5/2005
JP 2011-021550 2/2011
JP 2011-026985 2/2011

* cited by examiner

*Primary Examiner* — Emmanuel Duke
(74) *Attorney, Agent, or Firm* — IPUSA, PLLC

(57) ABSTRACT

A cooling system includes a refrigerator and a thermal load application unit applying a thermal load to the refrigerator. A detector detects, when the thermal load is applied to the refrigerator by the thermal load application unit, a change in a physical quantity generated in the refrigerator or a refrigerator-mounting portion where the refrigerator is mounted. A determiner determines a maintenance timing of the refrigerator based on the change in the physical quantity detected by the detector.

14 Claims, 7 Drawing Sheets

COOLING SYSTEM AND MAINTENANCE TIMING DETERMINATION METHOD

CROSS-REFERENCE TO RELATED APPLICATIONS

This application is based upon and claims the benefit of priority of the prior Japanese Patent Application No. 2012-116653, filed on May 22, 2012, the entire contents of which are incorporated herein by reference.

BACKGROUND OF THE INVENTION

1. Field of the Invention

The present invention relates to a cooling system having a refrigerator and a maintenance timing determination method.

2. Description of the Related Art

Generally, a cooling system for cooling an object to be cooled at a cryogenic temperature (an extremely low temperature) is provided with a refrigerator for cooling the object. As for such a refrigerator, a GM (Gifford-McMahone) refrigerator, which has a high reliability and is capable of being miniaturized, is used in many cases.

The GM refrigerator includes components that degrade over time such as sliding parts, filters, etc. In association with the temporal degradation of those component parts, the refrigeration capacity of the refrigerator is degraded. Thus, a GM refrigerator needs to be subjected to a maintenance operation.

SUMMARY OF THE INVENTION

There is provided according to an aspect of the invention a cooling system including: a refrigerator; a the/mal load application unit applying a thermal load to the refrigerator; a detector detecting, when the thermal load is applied to the refrigerator by said thermal load application unit, a change in a physical quantity generated in the refrigerator or a refrigerator-mounting portion where the refrigerator is mounted; and a determiner determining a maintenance timing of the refrigerator based on the change in the physical quantity detected by the detector.

There is provided according to another aspect of the invention a maintenance timing determination method of determining a maintenance timing of a refrigerator mounted in a refrigerator-mounting portion, the maintenance timing determination method including: applying a thermal load to the refrigerator; detecting a change in a physical quantity generated in the refrigerator or the refrigerator-mounting portion; and determining the maintenance timing of the refrigerator based on the detected change in the physical quantity.

According to embodiments of the present invention, a maintenance timing at which a maintenance operation is applied to the refrigerator can be determined accurately and easily because the maintenance timing is determined based on a change in a physical quantity generated in the refrigerator-mounting portion by applying a thermal load to the refrigerator.

The object and advantages of the embodiments will be realized and attained by means of the elements and combinations particularly pointed out in the appended claims.

It is to be understood that both the foregoing general description and the following detailed description are exemplary explanatory only and are not restrictive of the invention, as claimed.

DETAILED DESCRIPTION OF ILLUSTRATIVE EMBODIMENTS

A service period of a GM refrigerator, during which time degradation is generated is determined, and a maintenance operation is performed at the time when the service period has passed, regardless of whether a degradation of the refrigeration capacity of the GM refrigerator has actually occurred. Alternatively, a maintenance operation is applied to a GM refrigerator when an abnormality is detected in a cooling system including the GM refrigerator due to a remarkable degradation in the cooling capacity of the GM refrigerator.

However, according to a method of determining a maintenance timing by estimating a temporal degradation period, there may be a case where a maintenance operation is applied to a refrigerator that does not actually require a maintenance operation yet, thereby causing a problem in that the operation efficiency of the cooling system becomes low.

Moreover, according to a method of applying a maintenance operation to a refrigerator when an abnormality occurs in a cooling system due to a degradation in the refrigeration capacity of the refrigerator, there is a problem in that an operation of the cooling system must be stopped over a long period of time.

Figure 1:
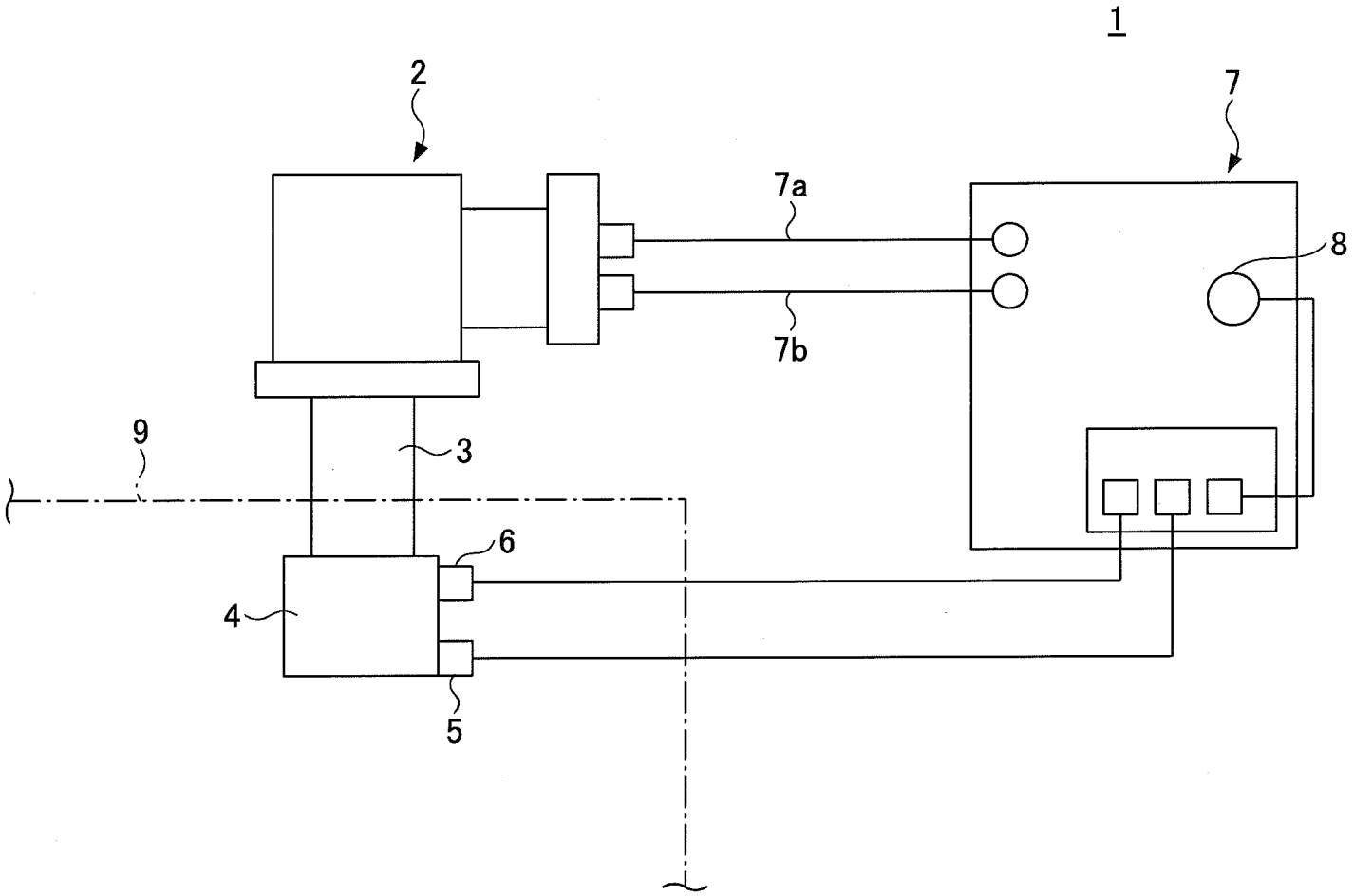
FIG. 1 is a block diagram of a cooling system according to a first embodiment of the present invention.

FIG. 1 illustrates a cooling system 1 according to a first embodiment of the present invention. The cooling system 1 includes a GM (Gifford-McMahon) refrigerator 2 and a compressor/controller 7.

The GM refrigerator 2 is mounted in a refrigerator-mounting portion 9 in order to cool a cooling object (not illustrated in FIG. 1), which is an object to be cooled, received in the refrigerator-mounting portion 9. The GM refrigerator 2 includes a cylinder 3 in which a displacer is provided in a reciprocally movable manner. Although not illustrated in FIG. 1, a mechanical part, which causes the displacer to reciprocally move in the cylinder 3, and valves, which allow a refrigerant gas to be supplied to or discharged from the cylinder 3, are provided in an upper part of the cylinder 3.

An expansion space is formed on a low-temperature side of the cylinder 3 between the cylinder and the displacer. The refrigerant gas is supplied to and discharged from the cylinder 3 by a movement of the displacer within the cylinder 3 and operations of the valves at necessary timings so that the refrigerant gas is adiabatically expanded in the expansion space to generate coldness. A cooling stage 4 is thermally connected to the low-temperature side of the cylinder 3 (a lower end part of the cylinder 3 in FIG. 1)

The coldness generated on the low-temperature side of the cylinder 3 is transmitted to the cooling object through the cooling stage 4, thereby, cooling the cooling object.

In the present embodiment, the compressor supplies a high-pressure refrigerant to the GM refrigerator 2, and pressurizes the refrigerant returned from the GM refrigerator 2. The controller performs a maintenance timing determination process mentioned later based on temperature information of the cooling stage 4 sent from a temperature sensor 5.

A high-pressure pipe 7*a* for delivering a high-pressure refrigerant to the GM refrigerator 2 and a low-pressure pipe 7*b* to return a low-pressure refrigerant gas from the GM refrigerator 2 are connected between the GM refrigerator 2 and the compressor/controller 7.

The temperature sensor 5 (detector) and a heater 6 are provided at the above-mentioned cooling stage 4 of the GM refrigerator 2. The temperature sensor 5 corresponds to a detector, which measures a temperature of the cooling stage 4. The temperature information representing a temperature of the cooling stage 4 measured by the temperature sensor 5 is sent to the compressor/controller 7.

The heater 6 heats the cooling stage 4. That is, the heater 6 serves as a thermal load application unit, which applies a thermal load to the GM refrigerator 2. The heater 6 generates heat by being supplied with electric power from the compressor/controller 7.

Although the GM refrigerator 2 of a single-stage type is used in the present embodiment, the present invention is not limited to a single-stage GM refrigerator and is applicable to a multistage GM refrigerator.

The mechanical part of the GM refrigerator 2 includes time-degrading component parts such as a sliding part, a filter, etc. As mentioned above, the refrigeration capacity of the GM refrigerator 2 is reduced due to degradation of those component parts. A description is given below of a maintenance timing determination process of the GM refrigerator 2 performed by the compressor/controller 7 in the above-mentioned cooling system 1.

Figure 2A:
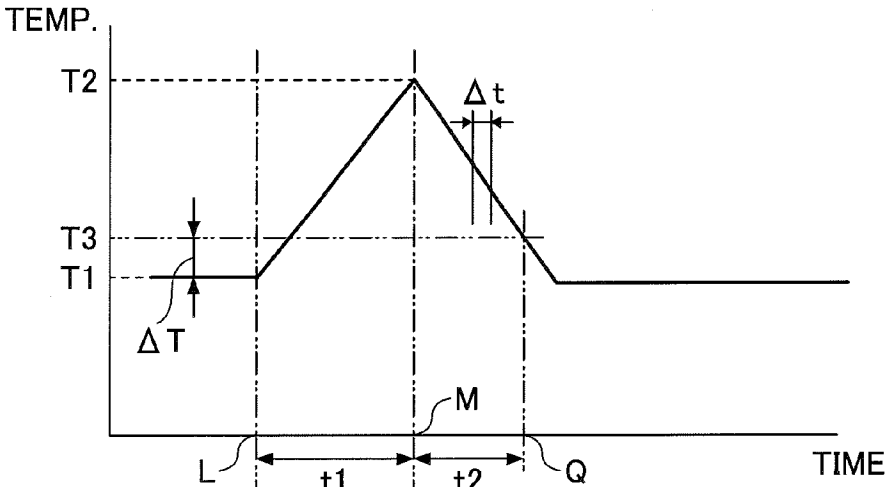
FIG. 2A is a graph indicating a temperature characteristic in the cooling system according to the first embodiment when a thermal load is applied to the cooling system by stopping a GM refrigerator and when a maintenance operation is not required.
Figure 2B:
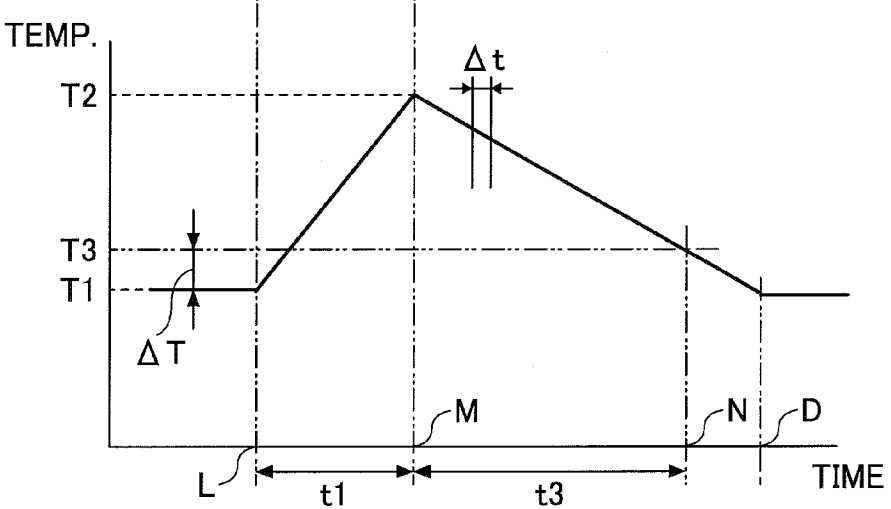
FIG. 2B is a graph indicating a temperature change when a maintenance operation is required.

FIGS. 2A and 2B are graphs for explaining a first embodiment of the maintenance timing determination process of the GM refrigerator 2 performed by the compressor/controller 7. In FIGS. 2A and 2B, the vertical axis represents a temperature of the stage 4 and the horizontal axis represents a time.

According to the maintenance timing determination process of the present embodiment, a thermal load is applied to the GM refrigerator 2. Then, a change in a physical quantity, which is generated in the GM refrigerator 2 or the refrigerator-mounting portion 9, due to the application of the thermal load is detected. As mentioned later, the change in the physical quantity to be detected includes a temperature change, a pressure change, etc. Then, the maintenance timing of the GM refrigerator 2 is determined based on an amount of the change in the physical quantity or a rate of the change in the physical quantity.

In the embodiment indicated in FIGS. 2A and 2B, a thermal load is applied to the GM refrigerator 2 by causing the GM refrigerator 2 to stop operating. The stopping of the GM refrigerator 2 is achieved by stopping a supply of the refrigerant or reducing an operation frequency by the compressor/controller 7 or by reducing its operation frequency. Alternatively, the stopping of the GM refrigerator 2 is achieved by stopping or reducing an operation frequency of a driving part provided at the GM refrigerator 2. Accordingly, the compressor/controller 7 corresponds to a stopping device for stopping the GM refrigerator 2 by applying a thermal load to the GM refrigerator 2. It should be noted that both the compressor/controller 7 and the GM refrigerator 2 may be stopped.

FIG. 2A illustrates a temperature characteristic of the GM refrigerator 2 in a state where maintenance is not required. FIG. 2A illustrates an example in which the GM refrigerator 2 is stopped or deactivated at a time L, and is activated again at a time M.

As illustrated in FIG. 2A, a temperature of the cooling stage 14 measured by the temperature sensor 5 rises when the GM refrigerator 2 is stopped. In the example illustrated in FIG. 2A, the temperature of the cooling stage 14 rises to T2 during a period from the time L at which the GM refrigerator 2 is deactivated or stopped until the time M at which the GM refrigerator 2 is re-activated or re-driven again.

When the GM refrigerator 2 is re-driven at the time M, the temperature of the cooling stage 14 decreases. At this time, because the GM refrigerator 2, which is set in a state where maintenance is not required, maintains a high refrigeration capacity, the temperature of the cooling stage 14 returns to a temperature T3 at a time Q within a period of time t2, which is a relatively short period of time. The temperature T3 is higher than an initial temperature T1 by an offset temperature AT. The time required by the temperature of the cooling stage 14 to return to the temperature T3 is referred to as a return time. It should be noted that the offset temperature ΔT may be set to zero in order to set the temperature 3 to be equal to the initial temperature T1.

On the other hand, FIG. 2B illustrates a temperature characteristic of the GM refrigerator 2 in a state where a considerable degradation is generated in component parts and maintenance is required. A period of stop time t1 during which the GM refrigerator 2 is stopped is equal to the stop time of the GM refrigerator 2 in a state illustrated in FIG. 2A where maintenance is not required.

It can be understood from FIG. 2B that the GM refrigerator 2, which is set in a state where maintenance is not required, requires a long return time t3 until the temperature of the cooling stage 14 returns to the temperature T3 after the GM refrigerator 2 is re-driven because the GM refrigerator 2 requiring maintenance has a low cooling efficiency. In the example illustrated in FIG. 2B, the temperature of the cooling stage 14 reaches the temperature T3, which is offset from the initial temperature by the temperature ΔT, at a time N after the GM refrigerator 2 is re-driven at the time M. Then, the temperature of the cooling stage 14 reaches the initial temperature T1 at a time D.

As mentioned above, it can be determined as to whether the GM refrigerator 2 requires maintenance by detecting a temperature change (a change in a physical quantity) generated after a thermal load is applied to the GM refrigerator 2. Specifically, necessity of maintenance of the GM refrigerator 2 can be determined by measuring a temperature change of the cooling stage 14 after the GM refrigerator 2 is stopped. Thus, by performing the maintenance timing determination process according to the present embodiment, a maintenance timing of the GM refrigerator 2 can be determined accurately and easily.

Figure 3:
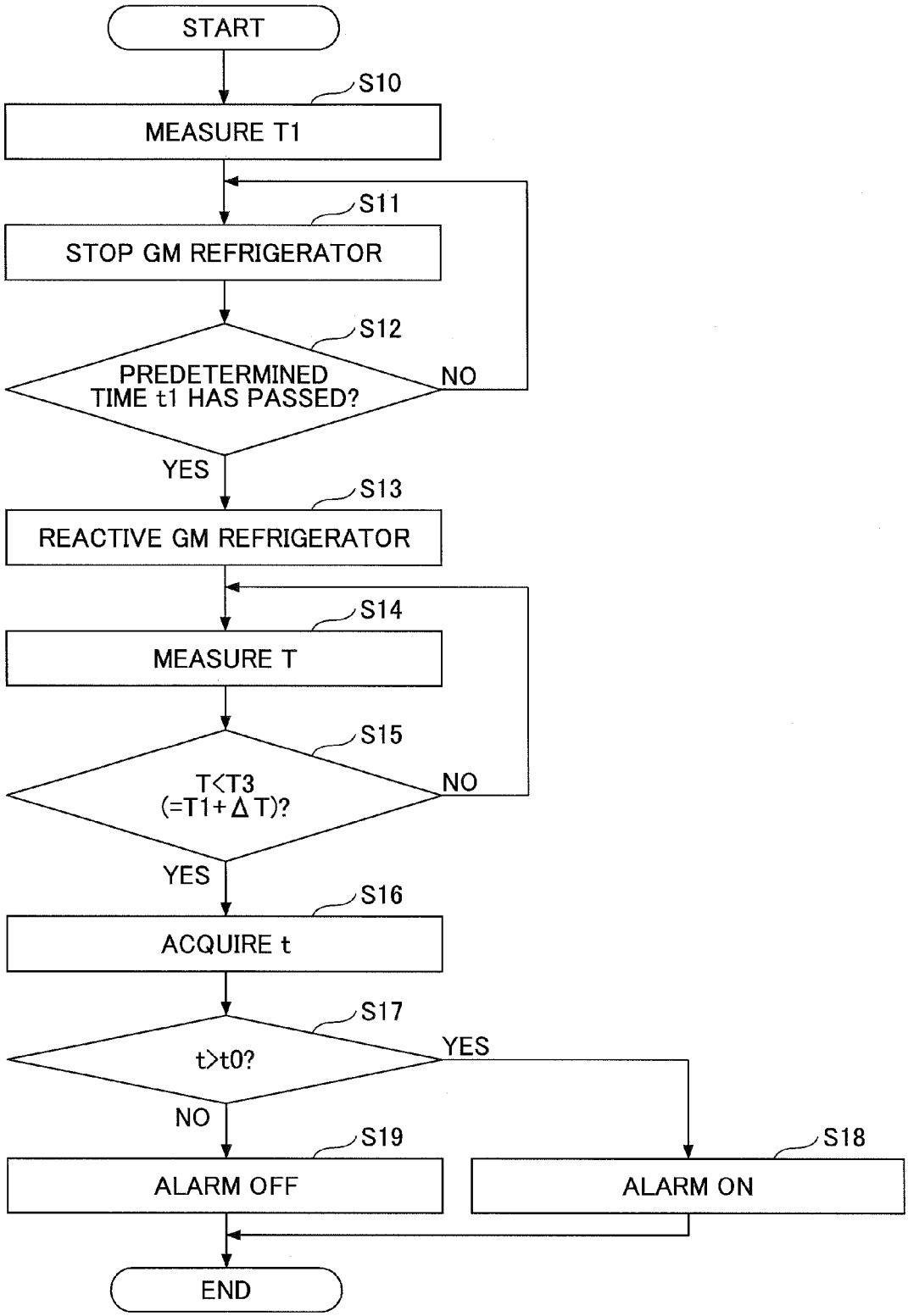
FIG. 3 is a flowchart of a process of determining a maintenance timing.

FIG. 3 is a flowchart of a maintenance timing determination process performed by the compressor/controller 7 (corresponding to a combination of a thermal load application unit and a determiner) according to the above-mentioned principle.

The maintenance timing determination process illustrated in FIG. 3 is started by a trigger signal, which is generated by, for example, a timer or the like incorporated in the compressor/controller 7. The trigger signal is generated at a predetermined time interval. When the maintenance timing determination process is started, first the compressor/controller 7 measures, at step S10, the initial temperature T1 of the cooling stage 14 using the temperature sensor 5. Information regarding the measured initial temperature T1 is stored in a memory device of the compressor/controller 7.

Then, at step S11, the GM refrigerator 2 is stopped. Thereby, the cooling process of the GM refrigerator 2 is stopped, which results in rising of the temperature of the cooling stage 14.

At step S12, the compressor/controller 7 determines whether a predetermined time t1 has passed after the stopping of the GM refrigerator 2. The predetermined time t1 is set to a time period during which a sufficient temperature change (a sufficient change in a physical quantity) is generated in the GM refrigerator 2 in the state requiring maintenance and the GM refrigerator 2 in the state not requiring maintenance, such that a determination as to whether the GM refrigerator 2 requires maintenance can be made accurately and easily. The GM refrigerator 2 is continuously stopped continuously until the predetermined time t1 passes.

After the predetermined time t1 passes, the process proceeds to step S13. At step S13 the compressor/controller 7 re-drives the GM refrigerator 2. Thereby the cooling stage 14 is set in a state where the cooling stage 14 is cooled by the GM refrigerator 2. The compressor/controller 7 activates a timer incorporated therein simultaneously with re-driving the GM refrigerator 2.

At the subsequent step S14, the compressor/controller 7 measures the temperature T of the cooling stage 14 using the temperature sensor 5. Then, the compressor/controller 7 determines, at step S15, whether the measured temperature T of the cooling stage 14 after re-driving the GM refrigerator 2 has become lower than the temperature T3, which is offset from the initial temperature T1 by the temperature T. The process of step S14 is repeated (NO of step S15) until it is determined at step S15 that the temperature T becomes equal to or higher than the temperature T3.

If it is determined at step S15 that the temperature T of the cooling stage 14 is equal to or lower than the temperature T3 (YES of step S15), the process proceeds to step S16 where the compressor/controller 7 acquires a time value t (that is, a return time t) of the timer which was activated simultaneously with re-driving the GM refrigerator 2. At the subsequent step S17 the compressor/controller 7 compares a return time t0, which is acquired from the GM refrigerator 2 which is set in a state where maintenance is not required (hereinafter, referred to as a reference return time t0), with the return time t measured at step S16. The reference return time t0 is acquired beforehand according to experiments or an experimental rule.

If the return time t measured in step S16 is shorter than the reference return time t0, the GM refrigerator 2 does not require maintenance. Thus, if it is determined at step S17 that the return time t is not longer than the reference return time t0, that is, if a negative determination is made at step S17 (NO of step S17), the process proceeds to step S19. At step S19, if an alarm 8 is currently activated, the alarm 8 is turned off, or if the alarm 8 is not activated, the non-activated state of the alarm 8 is maintained, and, then, the process is ended.

On the other hand, if it is determined at step S17 that the return time t is longer than the reference return time t0, the GM refrigerator 2 requires maintenance. Thus, if a positive determination is made at step S17 (YES of step S17), the process proceeds to step S18 where the compressor/controller 7 activates the alarm 8. Thereby, a user of the cooling system 1 is notified of the fact that the GM refrigerator 2 requires maintenance.

Means for sending a notification that the GM refrigerator 2 requires maintenance is not limited to the means explained in the present embodiment. If an observer is monitoring the cooling system 1 at a location remote from the cooling system 1, means for notifying the observer of such a fact that the GM refrigerator 2 requires maintenance may be used. Moreover, an observer monitoring the cooling system 1 may identify a refrigerator, which requires maintenance, and a location of installation of the refrigerator by using a GPS or the like incorporated in the refrigerator so as to perform maintenance and management of the cooling system 1 through a network such as, for example, the Internet without affecting a user of the cooling system 1.

In the above-mentioned embodiment, a time required by the cooling stage 14 to return to the initial temperature T1 after the GM refrigerator 2 is re-driven is measured in order to make a determination, based on the measured time, whether the GM refrigerator 2 requires maintenance. However, the determination of whether the GM refrigerator 2 requires maintenance can be made by acquiring a temperature change of the cooling stage 14 per a unit time.

That is, in the case where the GM refrigerator 2 does not require maintenance as illustrated in FIG. 2A, an amount of temperature change per a unit time (At indicated in FIG. 2A) is a large value. On the other hand, in the case where the GM refrigerator 2 requires maintenance as illustrated in FIG. 2B, an amount of temperature change per a unit time At is smaller than that of the case where the GM refrigerator 2 does not require maintenance.

Therefore, in order to determine whether the GM refrigerator 2 requires maintenance, an amount of temperature change per At of the GM refrigerator 2, which does not require maintenance, may be acquired according to experiments or an experimental rule. Then, the thus-acquired amount of temperature change is compared with an amount of temperature change per At of the GM refrigerator 2, which requires maintenance, thereby determining whether the GM refrigerator 2 requires maintenance.

Moreover, it may be determined as to whether the GM refrigerator 2 requires maintenance by measuring in advance a return time when the GM refrigerator 2 is in a relatively new condition and comparing a currently measured return time with the previously measured return time. For example, it can be determined that the GM refrigerator 2 requires maintenance if the currently measured return time is more than twice the previously measured return time.

Figure 4A:
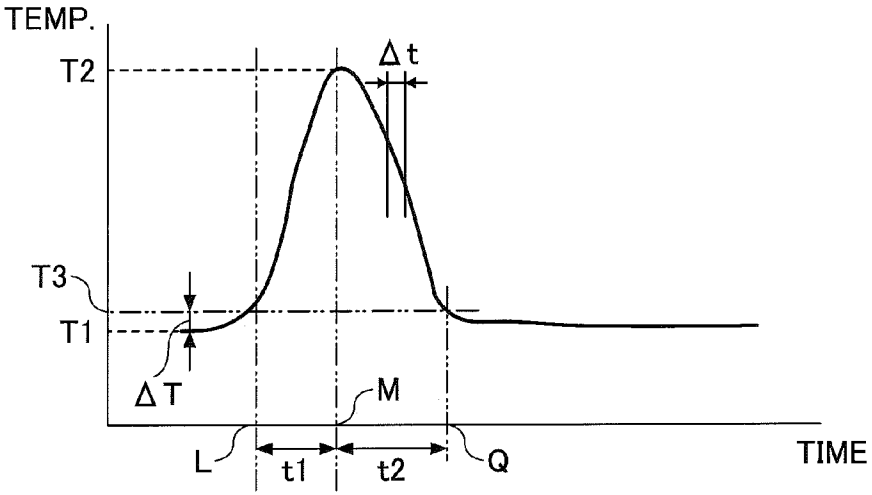
FIG. 4A is a graph indicating a temperature characteristic in the cooling system according to the first embodiment when a thermal load is applied to the cooling system by heating by a heater and when a maintenance operation is not required.
Figure 4B:
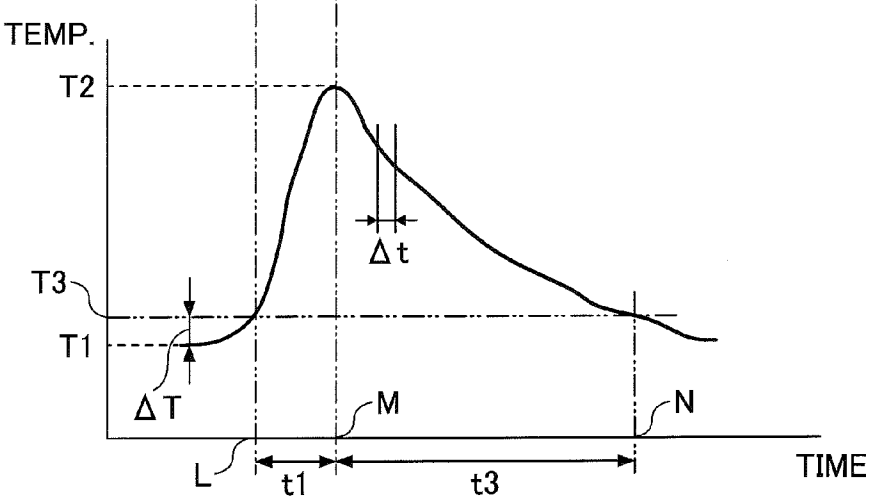
FIG. 4B is a graph indicating a temperature change when a maintenance operation is required.

A description will be given below, with reference to FIGS. 4A and 4B, of a method of determining the necessity of maintenance according to a second embodiment. In FIGS. 4A and 4B the vertical axis represents a temperature of the cooling stage 14, and the horizontal axis represents a time.

According to the maintenance timing determination method, which has been explained with reference to FIGS. 2A and 2B, a thermal load is applied to the GM refrigerator 2 by stopping an operation of the GM refrigerator 2. On the other hand, according to a maintenance timing determining method explained below, a thermal load is applied to the GM refrigerator 2 using a heater 6 provided to the cooling stage 14 of the GM refrigerator 2.

FIG. 4A indicates a temperature characteristic of the GM refrigerator 2, which does not require maintenance. FIG. 4A illustrates an example in which heating of the cooling stage 14 is started by activating the heater 6 at a time L and then the heating is stopped by deactivating the heater 6 at a time M.

As illustrated in FIG. 4A, the temperature of the cooling stage 14, which is measured by the temperature sensor 5, rises by being heated by the heater 6. In the example illustrated in FIG. 4A, the temperature of the cooling stage 14 rises to T2 in a period from the time L at which the heater 6 is activated to the time M at which the heater 6 is deactivated.

On the other hand, when the heater 6 is set in a deactivated state, the temperature of the cooling stage 14 falls. At this time, if the GM refrigerator 2 does not include degraded parts and is maintaining a high refrigeration capacity, the temperature of the cooling stage 2 returns to the temperature T3, which is offset from the initial temperature T1 by ΔT, within a relatively short return time (time t2).

FIG. 4B indicates a temperature characteristic of the GM refrigerator 2, which requires maintenance because degradation of parts has occurred. The heating time t1 of the cooling stage 14 by the heater 6 is made equal to the heating time of the GM refrigerator 2, which is set in a state requiring maintenance, as illustrated in FIG. 4A.

As illustrated in FIG. 4B, the GM refrigerator 2, which requires maintenance because degradation of parts has occurred, needs a long return time t3 because the cooling efficiency thereof is low.

Therefore, it can be determined accurately and easily as to whether the GM refrigerator 2 requires maintenance by measuring a temperature change of the cooling stage 14 after heating the cooling stage 14 by the heater 6.

It should be noted that also in the example illustrated in FIGS. 4A and 4B, the temperature change amount in the unit time Δt after deactivating the heater 6 differs between the GM refrigerator 2, which is in a state where maintenance is required, and the GM refrigerator 2, which is in a state where maintenance is not required.

That is, the temperature change amount of the GM refrigerator 2, which is in the state of requiring maintenance, is smaller than that of the GM refrigerator 2, which is in the state of not requiring maintenance. Thus, a determination as to whether the GM refrigerator 2 requires maintenance can be made, as explained with reference to FIGS. 2A and 2B, by acquiring the temperature change amount in the unit time Δt.

Figure 5:
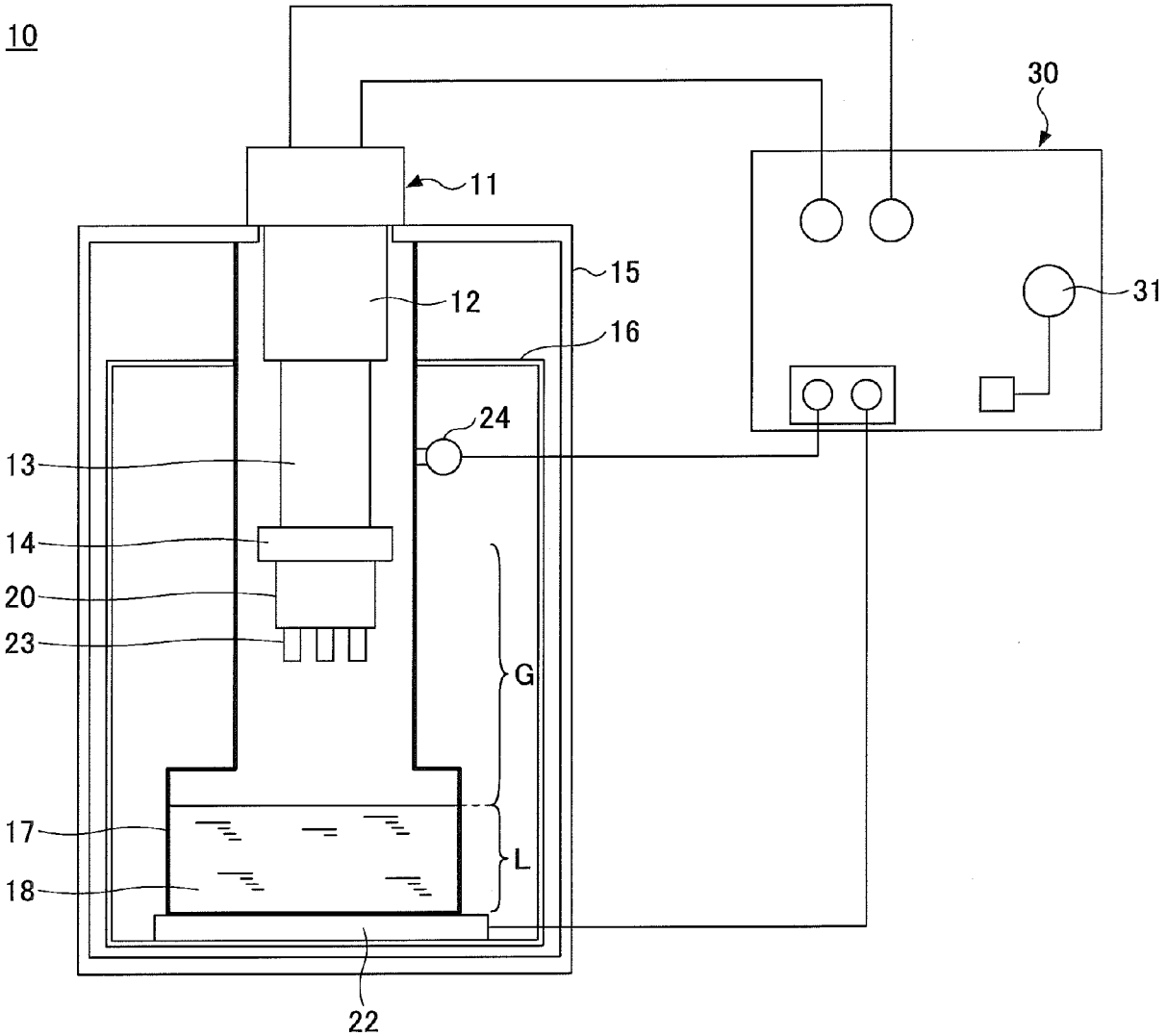
FIG. 5 is a block diagram of a cooling system according to a second embodiment of the present invention.

A description will be given below, with reference to FIG. 5, of a cooling system 10 according to a second embodiment of the present invention.

In the present embodiment, a cooling system is applied to a helium recondenser 10. The helium recondenser 10 according to the present embodiment includes a GM refrigerator 11, a vacuum chamber 15, a heat shield board 16, a liquid helium container 17, a heater 22, a condenser 23, a pressure sensor 24, and a compressor/controller 30.

The GM refrigerator 11 includes a first-stage cooling cylinder 12 and a second-stage cooling cylinder 13. A displacer incorporating a regeneration medium is reciprocally movable in each of the cylinders 12 and 13. The GM refrigerator 11 used in the present embodiment is configured to be capable of achieving cooling at 40 K in a cooling part of the first-stage cooling cylinder 12 and at 4 K in a cooling part of the second-stage cooling cylinder 13. According to such a temperature setting, the cooling part of the second-stage cooling cylinder 13 can be set at a liquid helium temperature.

The vacuum chamber 15 (refrigerator-mounting portion) is a metal-made housing. The GM refrigerator 11 is mounted in the vacuum chamber 15. The vacuum chamber 15 is connected to a vacuum pump, which is not illustrated in the figure. A vacuum is formed inside the vacuum chamber 15 so as to prevent heat from entering inside the vacuum chamber 15 from the outside.

The heat shield board 16, which is a metal-made housing, is provided in the vacuum chamber 15. Although not illustrated in the figure, the heat shield board 16 is thermally connected to the first-stage cooling cylinder 12 of the GM refrigerator 11. Thus, the heat shield board 16 is cooled by the GM refrigerator 11 to prevent a radiant heat from entering inside the heat shield board 16.

The liquid helium container 17 (tank) is arranged inside the heat shield board 16. The liquid helium container 17 is a hermitic container in which liquid helium 18 used as a refrigerant (cryogen) is filled. The liquid helium container 17 is not entirely filled with the liquid helium 18. That is, in the liquid helium container 17, helium is separated into a liquid phase L, which is the liquid helium 18, and a gas phase G, which is generated by evaporation of the liquid helium 18.

The condenser 23 is arranged in the gas phase G inside the liquid helium container 17. The condenser 23 cools and recondenses the helium gas generated by evaporation of the liquid helium 18 to return the helium gas to the liquid phase L. The condenser 23 may be cooled by the GM refrigerator 11 through a temperature damper 20.

The temperature damper 20 can be arranged between the cooling stage 14 of the GM refrigerator 11 and the condenser 23. The temperature damper 20 has a function of absorbing a temperature change in the cooling stage 14.

The heater 22 is arranged on the bottom of the liquid helium container 17, and is connected to a compressor/controller 30. The heater 22 generates heat by being supplied with electric power from the compressor/controller 30 in order to heat the liquid helium 18 in the liquid helium container 17. Therefore, the heater 22 serves as a thermal load application unit to apply a thermal load to the GM refrigerator 11.

The pressure sensor 24 is arranged in the liquid helium container 17. Therefore a pressure inside the liquid helium container 17 is measurable by the pressure sensor 24. Information regarding a pressure in the liquid helium container 17 detected by the pressure sensor 24 is sent to the compressor/controller 30.

In the present embodiment, the compressor/controller 30 is a unified unit in which a compressor and a controller are incorporated. The compressor pressurizes a refrigerant returned from the GM refrigerator 11 and supplies the high-pressure refrigerant to the GM refrigerator 11. The controller carries out a maintenance timing determination process mentioned later based on the information regarding pressure inside the liquid helium container 17 supplied from the pressure sensor 24.

Figure 6A:
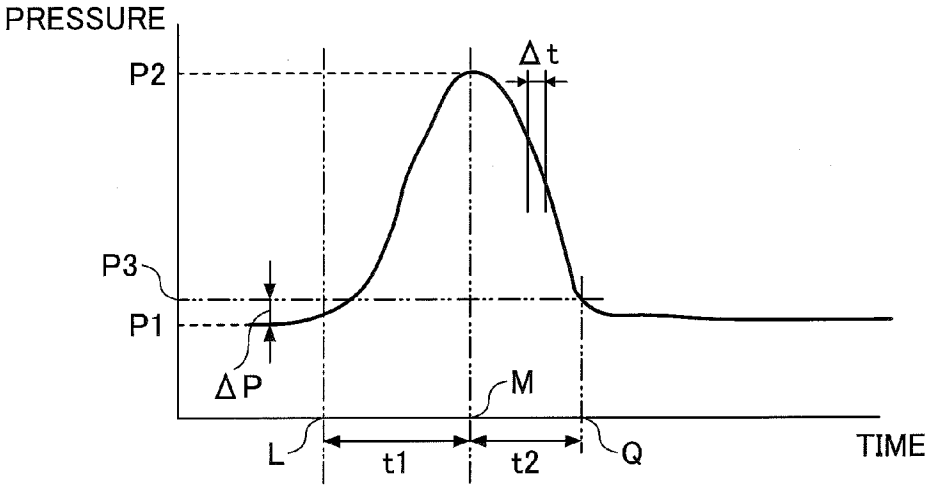
FIG. 6A is a graph indicating a pressure characteristic in the cooling system in the cooling system according to the second embodiment when a thermal load is applied to the cooling system by heating by a heater and when a maintenance operation is not required.
Figure 6B:
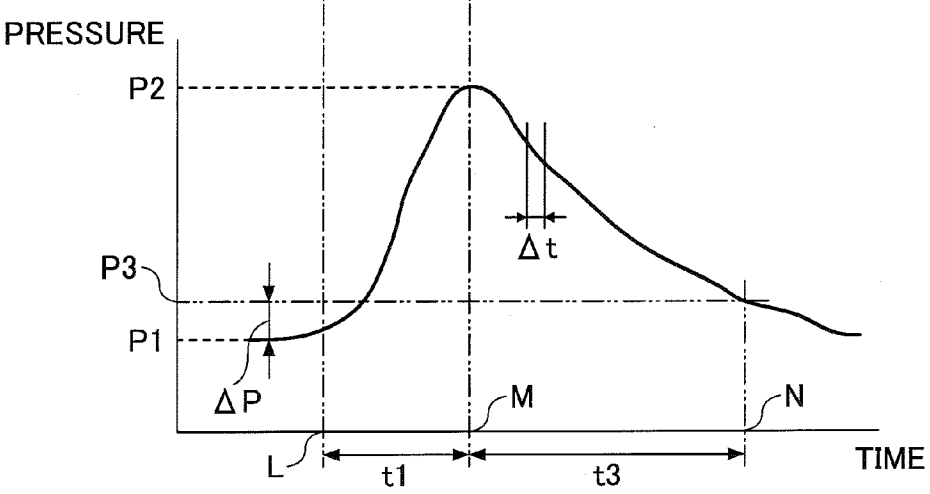
FIG. 6B is a graph indicating a pressure characteristic when a maintenance operation is not required.

A description will be given below, with reference to FIGS. 6A and 6B, of a method of determining maintenance timing according to a third embodiment. In the present embodiment, a thermal load is applied to the GM refrigerator 11 incorporated in the helium re-condenser 10 so as to determine whether maintenance of the GM refrigerator 11 is required based on a change in a physical quantity generated due to the application of the thermal load. In FIGS. 6A and 6B, the vertical axis represents pressure inside the liquid helium container 17, and the horizontal axis represents time.

According to the maintenance timing determination method, which has been explained with reference to FIGS. 2A and 2B, a thermal load is applied to the GM refrigerator 2 by stopping an operation of the GM refrigerator 2. On the other hand, according to the maintenance timing determining method according to the present embodiment explained below, a thermal load is applied to the GM refrigerator 11 by heating the liquid helium 18 in the liquid helium container 18 using the heater 22 provided in a lower part of the liquid helium container 17.

FIG. 6A indicates a pressure characteristic of the GM refrigerator 11, which does not require maintenance. FIG. 6A illustrates an example in which heating of the liquid helium 18 in the liquid helium container 17 is started by activating the heater 22 at a time L and then the heating is stopped by deactivating the heater 22 at a time M.

As illustrated in FIG. 6A, the temperature of the liquid helium 18 rises by being heated by the heater 22, and thereby a part of the liquid phase L of the liquid helium 18 is evaporated and changed into the gas phase G. Accordingly, after activating the heater 22, a pressure inside the liquid helium container 17 measured by the pressure sensor 24 rises. In the example illustrated in FIG. 6A, the pressure inside the liquid helium container 17 rises to P2 in a period from the time L at which the heater 22 is activated to the time M at which the heater 22 is deactivated.

On the other hand, when the heater 22 is deactivated, the pressure inside the liquid helium container 17 falls. At this time, if the GM refrigerator 11 does not include degraded parts and is maintaining a high refrigeration capacity, the pressure inside the liquid helium container 17 returns to a pressure P3, which is offset from an initial pressure P1 by ΔP, within a relatively short return time (time t2). The time period to return to the pressure P3 is referred to as a return time.

FIG. 6B indicates a pressure characteristic of the GM refrigerator 11, which requires maintenance because degradation of parts has occurred. The heating time t1 of the liquid helium container 17 by the heater 22 is made equal to that of the GM refrigerator 11, which is in a state of requiring maintenance.

As illustrated in FIG. 6B, the GM refrigerator 11 in the state requiring maintenance due to occurrence of degradation of parts needs a long return time because the cooling efficiency thereof is low. Thus, the GM refrigerator 11 in the state requiring maintenance needs a return time t3 longer than the return time t2 illustrated in FIG. 6A (t3>t2).

Therefore, it can be determined as to whether the GM refrigerator 11 currently requires maintenance by measuring a pressure change in the liquid helium container 17 after heating the liquid helium 18 by the heater 22.

In the example illustrated in FIGS. 6A and 6B, the pressure change amount in the unit time Δt after deactivating the heater 22 differs between the GM refrigerator 11 in the state requiring maintenance and the GM refrigerator 11 in the state not requiring maintenance. That is, a pressure change amount in the unit time Δt of the GM refrigerator 11 in the state requiring maintenance is smaller than that of the GM refrigerator 11 in the state not requiring maintenance. Thus, it is also possible to make a determination as to whether maintenance of the GM refrigerator 11 is needed by acquiring the pressure change amount in the unit time Δt.

Figure 7A:
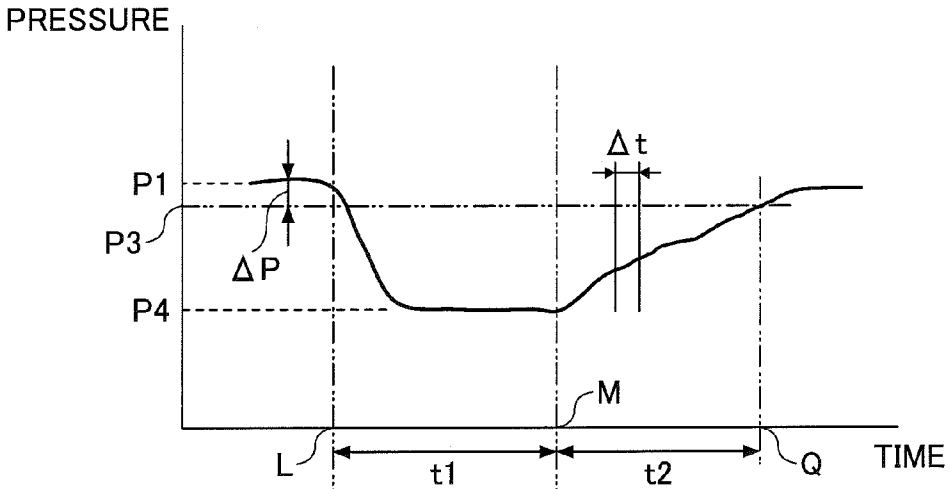
FIG. 7A is a graph indicating a pressure characteristic in the cooling system in the cooling system according to the second embodiment when a thermal load is applied to the cooling system by deactivating a heater and when a maintenance operation is not required.
Figure 7B:
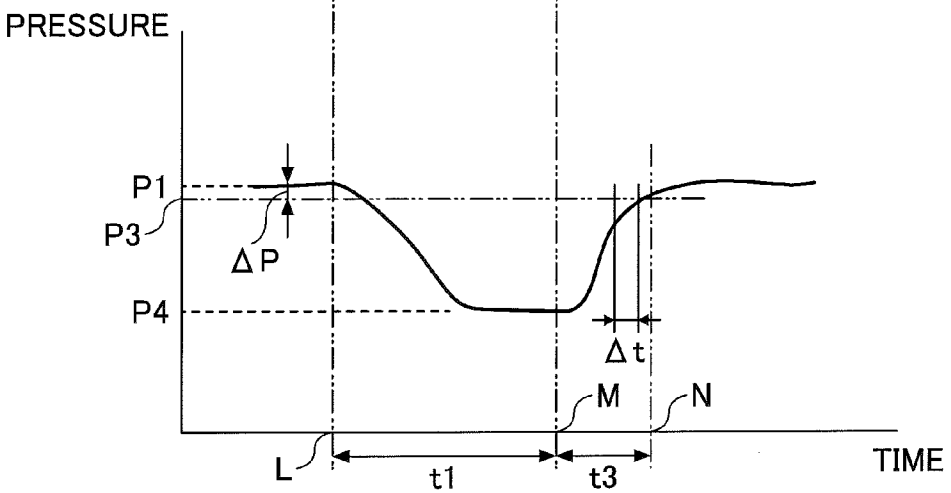
FIG. 7B is a graph indicating a pressure characteristic when a maintenance operation is not required.

A description will be given below, with reference to FIGS. 7A and 7B, of a method of determining a maintenance timing according to a fourth embodiment. In the present embodiment, a thermal load is applied to the GM refrigerator 11 incorporated in the helium recondenser 10 so as to determine whether maintenance of the GM refrigerator 11 is required based on a change in a physical quantity generated due to the application of the thermal load. In FIGS. 7A and 7B, the vertical axis represents a pressure inside the liquid helium container 17, and the horizontal axis represents a time.

Also in the example illustrated in FIGS. 7A and 7B, the liquid helium 18 in the liquid helium container 17 is heated using the heater 22 arranged on a lower part of the liquid helium container 17. However, according to the determination method explained below, preheating is applied to the liquid helium container 17 beforehand.

Thus, also in the present determination method, the heater 22 serves as a thermal load application unit to apply a thermal load to the GM refrigerator 11. It should be noted that, also in FIGS. 7A and 7B, the vertical axis represents a pressure inside the liquid helium container 17 and the horizontal axis represents a time.

FIG. 7A indicates a pressure characteristic of the GM refrigerator 11, which does not require maintenance. FIG. 7A illustrates an example in which, in a state where pressure inside the liquid helium container 17 is set to a fixed pressure P1 by previously activating the heater 22, the heater 22 is deactivated at a time L and thereafter the heater 22 is re-activated at a time M.

As illustrated in FIG. 7A, after deactivating the heater 22, which has applied preheating, the helium of the gas phase G generated by evaporation of the liquid helium 18 in the liquid helium container 17 is condensed and liquefied by the condenser 23, which is cooled by the GM refrigerator 11. Thus, the pressure in the liquid helium container 17 is reduced to a pressure P4 in a period from the time L at which the heater 22 is deactivated to the time M at which the heater is re-activated.

On the other hand, when the heater 22 is deactivated, the pressure inside the liquid helium container 17 rises. At this time, if the GM refrigerator 11 does not include degraded parts and is maintaining a high refrigeration capacity, the pressure inside the liquid helium container 17 returns to a pressure P3, which is offset from an initial pressure P1 by ΔP, within a relatively long return time (time t2).

FIG. 7B indicates a pressure characteristic of the GM refrigerator 11, which requires maintenance because degradation of parts has occurred. The deactivation time t1 of the heater 22 is made equal to that of the GM refrigerator 11 of the state of requiring maintenance.

As illustrated in FIG. 7B, the GM refrigerator 11 in the state requiring maintenance due to occurrence of degradation of parts needs a short return time because the cooling efficiency thereof is low. Thus, the GM refrigerator 11 in the state requiring maintenance needs a return time t3 longer than the return time t2 illustrated in FIG. 7A (t3>t2).

Therefore, it can be determined as to whether the GM refrigerator 11 currently requires maintenance by measuring pressure change in the liquid helium container 17 by deactivating the heater 22, which has applied preheating, and thereafter re-activating the heater 22.

In the example illustrated in FIGS. 7A and 7B, the pressure change amount in the unit time Δt after re-activating the heater 22 differs between the GM refrigerator 11 in the state requiring maintenance to the GM refrigerator 11 in the state not requiring maintenance. That is, a pressure change amount in the unit time Δt of the GM refrigerator 11 in the state requiring maintenance is larger than that of the GM refrigerator 11 in the state not requiring maintenance. Thus, it is also possible to make a determination as to whether maintenance of the GM refrigerator 11 is needed by acquiring the pressure change amount in the unit time Δt.

Furthermore, in the example illustrated in FIGS. 7A and 7B, the characteristic of the pressure in the liquid helium container 17 falling from P3 to P4 after deactivating the heater 22 differs between the GM refrigerator 11 in the state requiring maintenance to the GM refrigerator 11 in the state not requiring maintenance. That is, the pressure in the liquid helium container 17 of the GM refrigerator 11 in the state requiring maintenance falls slower than that of the GM refrigerator 11 in the state not requiring maintenance. Thus, it is also possible to make a determination as to whether maintenance of the GM refrigerator 11 is needed by measuring a pressure change in the liquid helium container 17 after deactivating the heater 22 and until re-activating the heater 22.

In the above-mentioned embodiments, the temperature sensor 5 or the pressure sensor 24 and the controller of the compressor/controller 7 or 30 together constitute a detector that detects, when a thermal load is applied to the refrigerator 2 or 11 by the thermal load application unit, a change in a physical quantity generated in the refrigerator 2 or 11 or the refrigerator-mounting portion where the refrigerator 2 or 11 is mounted.

Moreover, in the above-mentioned embodiments, a processor provided in the controller of the compressor/controller 7 or 30 constitutes a determiner that determines maintenance timing of the refrigerator 2 or 11 based on a change in a physical quantity detected by the detector.

It should be noted that the above-mentioned compressor/controller 7 or 30 performs a determination process based on the determination method according to one of the embodiments explained with reference to FIGS. 4A and 4B, 6A and 6B, and 7A and 7B. The determination process is basically the same as the determination process explained with reference to FIG. 3 except that the thermal load applied to the GM refrigerator 2 or 11 in steps S11-S13 is different. Thus, a description of the determination process performed by the compressor/controller 7 or 30 based on each of the embodiments explained with reference to FIGS. 4A and 4B, 6A and 6B, and 7A and 7B has been omitted.

Although preferred embodiments of the present invention have been explained in detail above, the present invention is not limited to the specifically disclosed embodiments, and variations and modifications may be made without departing from the scope of the present invention.

Specifically, the present invention is not limited to the cooling system using the GM refrigerator as explained in the embodiments, and other refrigerators such as a pulse-tube refrigerator, a Sterling refrigerator, a JT refrigerator, etc., may be used in the cooling system. Moreover, although the recondenser of liquid helium as a cryogen has been explained, other recondensers using other cryogens such as liquid nitrogen, liquid hydrogen, etc., may be used in the cooling system.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention (s) has(have) been described in detail, it should be understood that the various changes, substitutions, and alterations could be made hereto without departing from the spirit and scope of the invention.

What is claimed is:

1. A cooling system comprising: a refrigerator; a thermal load application unit applying a thermal load to said refrigerator; a detector detecting, when the thermal load is applied to said refrigerator by said thermal load application unit, a change in a physical quantity generated in said refrigerator or a refrigerator-mounting portion where said refrigerator is mounted; and a determiner determining a maintenance timing of said refrigerator based on a return time required for the physical quantity after the application of the thermal load to return to a predetermined physical quantity or an amount of change in the physical quantity per a unit time when the physical quantity of the application of the thermal load returns to an initial physical quantity.

2. The cooling system as claimed in claim 1, wherein the change in the physical quantity is a temperature change in a cooling stage of said refrigerator.

3. The cooling system as claimed in claim 1, wherein the change in the physical quantity is a pressure change in a tank of said refrigerator, the tank being filled with a cryogen.

4. The cooling system as claimed in claim 1, wherein said thermal load application unit is a stopping device that causes said refrigerator to stop operating.

5. The cooling system as claimed in claim 1 wherein said thermal load application unit is a heating device provided to a cooling stage of said refrigerator.

6. The cooling system as claimed in claim 1, wherein said refrigerator-mounting portion has a tank in which a cryogen is filled, and said thermal load application unit is a heater provided at said tank.

7. The cooling system as claimed in claim 1, said determiner determines that said refrigerator requires a maintenance when the return time is shorter than a reference return time that is previously obtained according to experiments or an experimental rule in a state where said refrigerator does not require a maintenance, or when the amount of change in the physical quantity per the unit time is smaller than a reference amount of change in the physical quantity per the unit time that is previously obtained according to experiments or an experimental rule in the state where said refrigerator does not require a maintenance.

8. A maintenance timing determination method of determining a maintenance timing of a refrigerator mounted in a refrigerator-mounting portion, the maintenance timing determination method comprising: applying a thermal load to said refrigerator; detecting a change in a physical quantity generated in said refrigerator or said refrigerator-mounting portion; and determining the maintenance timing of said refrigerator based on a return time required for the physical quantity after the application of the thermal load to return to a predetermined physical quantity or an amount of change in the physical quantity per a unit time when the physical quantity of the application of the thermal load returns to an initial physical quantity.

9. The maintenance timing determination method as claimed in claim 8, wherein the detection of the change includes measuring a temperature change in a cooling stage of said refrigerator.

10. The maintenance timing determination method as claimed in claim 8, wherein the detection of the change includes detecting a pressure change in a tank of said refrigerator, the tank being filled with a cryogen.

11. The maintenance timing determination method as claimed in claim 8, wherein the application of the thermal load includes causing said refrigerator to stop operating.

12. The maintenance timing determination method as claimed in claim 8 wherein the application of the thermal load includes heating a cooling stage of said refrigerator.

13. The maintenance timing determination method as claimed in claim 8, wherein the application of the thermal load includes heating a tank provided in said refrigerator-mounting portion, the tank being filled with a cryogen.

14. The maintenance timing determination method as claimed in claim 8, wherein the determination of the maintenance timing includes determining that said refrigerator requires a maintenance when the return time is shorter than a reference return time that is previously obtained according to experiments or an experimental rule in a state where said refrigerator does not require a maintenance, or when the amount of change in the physical quantity per the unit time is smaller than a reference amount of change in the physical quantity per the unit time that is previously obtained according to experiments or an experimental rule in the state where said refrigerator does not require a maintenance.

* * * * *